United States Patent [19]

Steinberg et al.

[11] 4,291,501

[45] Sep. 29, 1981

[54] DEVICE FOR COUNTERBALANCING A SWIVELABLE BODY PART ON A MOTOR VEHICLE

[75] Inventors: Klaus Steinberg, Prile; Gerhard Hoffmann, Neukeferloh, both of Fed. Rep. of Germany

[73] Assignee: Bayerische Motoren Werke Aktiengesellschaft, Munich, Fed. Rep. of Germany

[21] Appl. No.: 14,586

[22] Filed: Feb. 23, 1979

[30] Foreign Application Priority Data

Feb. 24, 1978 [DE] Fed. Rep. of Germany ..... 2808063

[51] Int. Cl.[3] ..... E05F 1/10

[52] U.S. Cl. ..... 49/386; 16/180

[58] Field of Search ..... 49/386; 267/154, 155, 267/57; 16/180, 85

[56] References Cited

U.S. PATENT DOCUMENTS

| | | | |
|---|---|---|---|
| 1,636,386 | 7/1927 | Oberreich | 267/154 X |
| 2,322,933 | 6/1943 | Harmon et al. | 16/180 X |
| 2,799,891 | 7/1957 | Ragsdale | 16/180 |
| 2,894,277 | 7/1959 | Bogater et al. | 267/154 X |
| 2,986,770 | 6/1961 | Hammond | 267/154 X |
| 4,133,074 | 1/1979 | Schack | 49/386 |

*Primary Examiner*—Philip C. Kannan

*Attorney, Agent, or Firm*—Craig and Antonelli

[57] ABSTRACT

A device for counterbalancing a swivelable body part on a motor vehicle, especially a trunk lid on an automobile, said device including a hinge for the swivelable body part and a torsion bar, the torsion bar being bent to form a crank in the vicinity of a movable hinge part. An intermediate lever is articulated on the movable hinge part and engages the crank, the crank including a crank pin between two legs, the legs being connected by arcuate segments both with the crank pin and with the torsion bar. The legs are made S-shaped so as to minimize waste, provide ease of manufacture and small installation space requirements for the crank.

5 Claims, 4 Drawing Figures

DEVICE FOR COUNTERBALANCING A SWIVELABLE BODY PART ON A MOTOR VEHICLE

BACKGROUND AND SUMMARY OF THE INVENTION

The present invention relates to a device for counterbalancing a swivelable body part on a motor vehicle, especially a trunk lid on an automobile, with a hinge for the swivelable body part or lid and a torsion bar, said bar being bent to form a crank in the vicinity of a movable hinge part of the hinge, an intermediate lever being articulated to the hinge part and engaging the crank, the crank including a crank pin between two legs, the legs being connected by arcuate sections with both the crank pin and the torsion rod.

A device of this kind is known, for example, from German Auslegeschrift No. 1,003,059. In this known design, the crank in the torsion rod, is made U-shaped, with legs parallel to one another. The arcuate sections at the transitions from the torsion rod to the legs, and from the legs to the crank pin, are made with a relatively small radius of curvature. In this manner, with a short mutual spacing of the legs, a crank pin, said pin being straight in its central area, is produced for reliable mounting of the intermediate lever. Also, in this design, the bearings, required on both sides of the crank to support the torsion rod, can be disposed with a small mutual spacing between them. This produces a device which requires only a small amount of space for installation in the trunk.

However, the small radii of curvature in the torsion rod in the vicinity of the crank in this known device is particularly disadvantageous in that it results in a considerable amount of waste and, consequently increased cost for the manufacture of the crank in the torsion rods, especially when reducing the weight of torsion rods made from expensive materials.

Therefore, an object of the present invention is to provide a device of the aforementioned type wherein the crank in the torsion rod is such that minimum waste results, with ease of manufacture and small installation space requirements for the crank.

This object is attained according to the present invention by providing that the legs of the crank are made S-shaped.

In the device according to the present invention narrow bending radii are avoided with conventional spacings of the crank pin from the torsion bar. Further, according to the present invention, the arcuate segments of the S-shaped legs, which terminate in the torsion bar, can be brought close together to provide a narrow crank and hence one which requires little room for installation. Such an arrangement also permits the support bearings for the torsion bar, usually provided on either side of the crank, to be located a short distance apart whereby narrow and consequently light bearing arrangements, for example on a bearing plate, can be employed.

With an appropriate choice of curve radii for the arcuate segments of the S-shaped legs connected with the crank pin, it is possible according to the present invention to provide a crank pin which is straight in its middle area for reliable support of the intermediate lever.

Further, it has been found to be advantageous in the device of the present invention, where the torsion bar is made from round stock, to provide that the average bending radius of each arcuate segment of the legs is equivalent a diameter at least twice the diameter of the torsion bar.

According to the present invention, the arcuate segments of each leg can merge directly with each other. According to another feature, the legs can have a straight intermediate segment between their arcuate segments, whereby the intermediate segments meet at an acute angle. Cranks of this type, with intermediate segments in the S-shaped legs converging in the direction of the torsion bar, are advantageous from the manufacturing standpoint for maintenance of accurate dimensions and shape. This design is especially advantageous for larger distances between the crank pin and the torsion bar axis, whereby the crank is given a trapezoidal shape by long intermediate sections.

BRIEF DESCRIPTION OF THE DRAWINGS

These and other objects, features and advantages of the present invention will become apparent from the following description when taken in connection with the accompanying drawings which show, for purposes of illustration only, two embodiments in accordance with the present invention, and wherein.

DETAILED DESCRIPTION OF THE DRAWINGS

Figure 1:
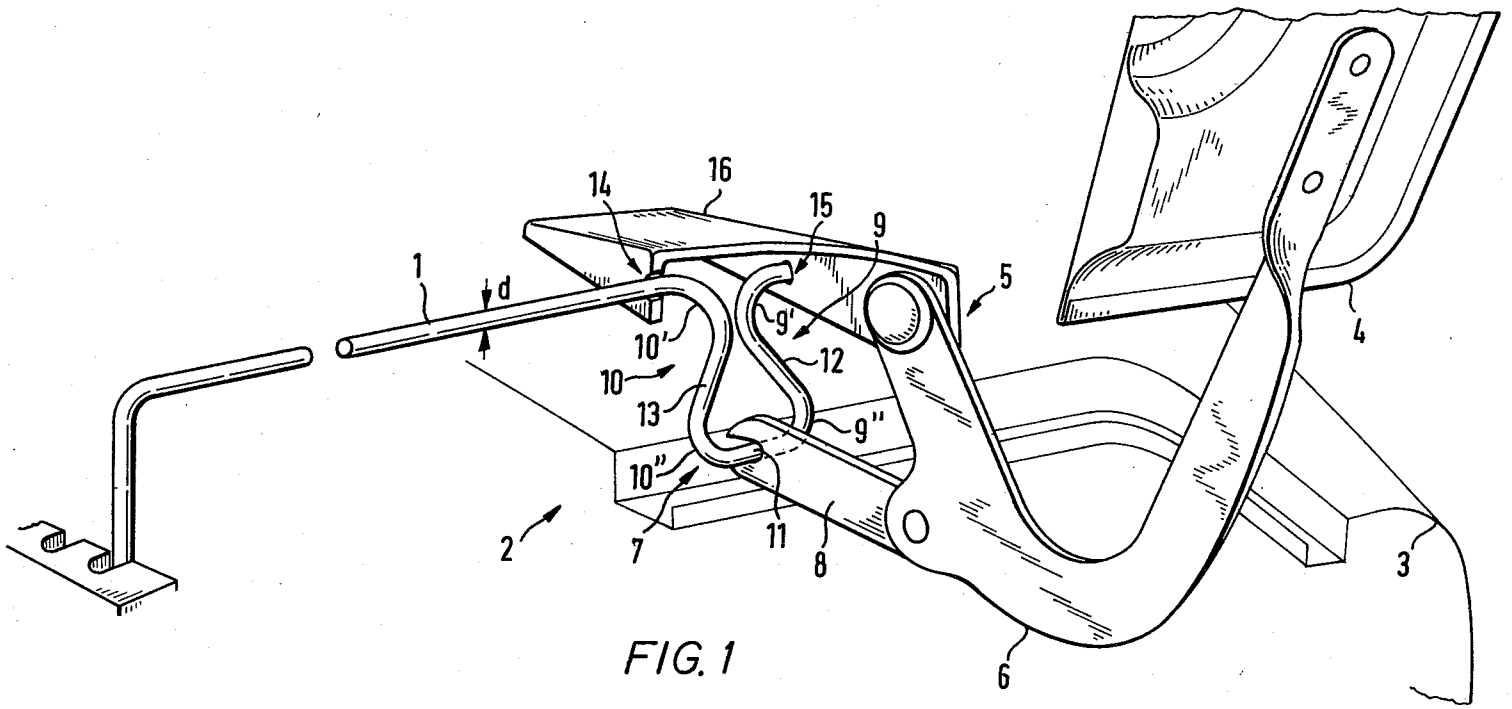
FIG. 1 is a schematic illustration of a device for counterbalancing a swivelable body part on a motor vehicle according to the present invention.

The device 2 of the present invention shown in FIG. 1 includes a torsion bar 1 for counterbalancing a trunk lid 4 which is articulated to swivel upward on an automobile 3, not shown in greater detail. Lid 4 is articulated on hinges, of which only one hinge is shown and designated by 5. Torsion bar 1 is bent to form a crank 7 in the vicinity of a movable hinge part 6. An intermediate lever 8, articulated to hinge part 6, engages the crank 7. Crank 7 comprises a crank pin 11 provided between two legs, 9 and 10, the intermediate lever 8 cooperating in an articulated manner with the crank pin.

Legs 9 and 10 are connected on the one hand by their arcuate segments 9′ and 10′, respectively, with torsion bar 1 and on the other hand by their arcuate segments 9″ and 10″, respectively, with crank pin 11. Legs 9 and 10 each have a straight intermediate segment, 12 and 13, respectively, between their arcuate segments 9′, 9″ and 10′, 10″, whereby intermediate segments 12 and 13 approach each other at an acute angle. The intermediate segments 12 and 13 of legs 9 and 10, converge in the direction of torsion bar 1 as shown in FIG. 1 and can have their arcuate segments 9′, 9″ and 10′, 10″ made with a relatively large average bending radius. In the case of a torsion bar 1 made from round stock, it has been found advantageous for each arcuate segment 9', 9'' and 10', 10'' of legs 9 and 10 to have a diameter at least twice the diameter "d" of torsion bar 1 in its central bending radius. With a bending radius of this nature for the above-mentioned arcuate segments of legs 9 and 10, the danger that torsion bar 1 will be rendered useless when crank 7 is produced is considerably reduced.

Arcuate segments 9', 9'' and 10', 10'', made with large bending radii, together with convergent intermediate segments 12, 13, form S-shaped legs 9, 10. The S-shaped configuration of legs 9, 10 results in a considerable reduction of the number of rejected torsion bars 1 following the forming of crank 7. Also, as a result of this configuration arcuate segments 9' and 10' of legs 9 and 10, on the side of the torsion bar, can be disposed with a small mutual spacing, whereby bearings 14 and 15, provided on either side of crank 7 to support torsion bar 1, can likewise be placed a short distance apart. A plate 16 to accept bearings 14 and 15 can therefore be made small and light.

A crank 7 with S-shaped legs 9 and 10, whose segments 9', 10' are disposed a short distance apart, has the further advantage that it is narrow and therefore requires little room for installation. In this regard, there is another advantage that can be achieved by using an S-shaped configuration for legs 9 and 10 according to the present invention, namely, crank pin 11 can be made straight in its central part. This permits intermediate lever 8 to be reliably mounted on crank pin 11.

Figure 2:
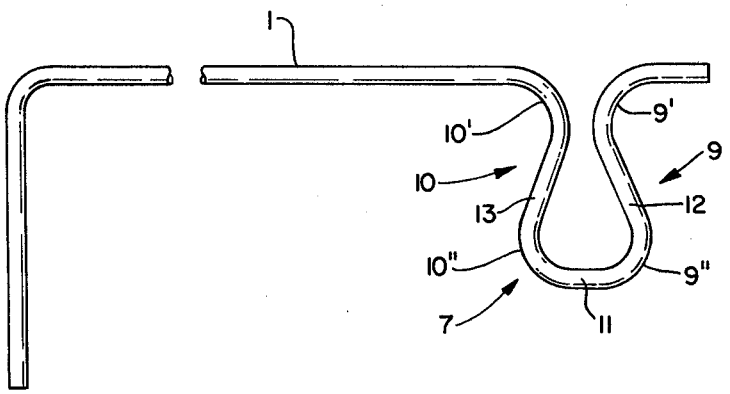
FIG. 2 is a perspective view of the torsion bar illustrated in FIG. 1.
Figure 3:
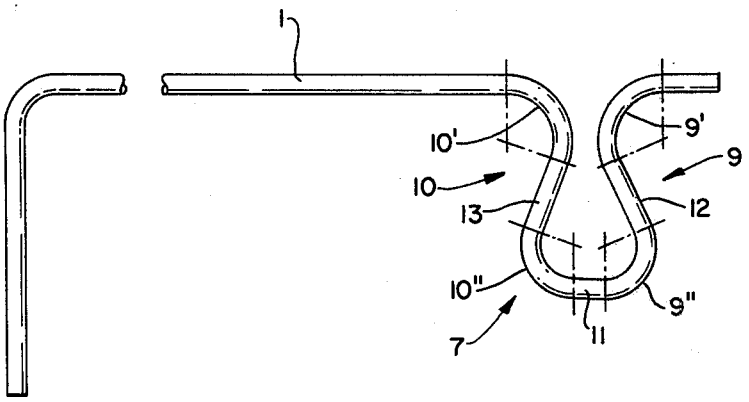
FIG. 3 is a perspective view of the torsion bar as shown in FIG. 2 with section lines added to clearly distinguish the respective arcuate segments and straight intermediate segments of the crank formed in the torsion bar.
Figure 4:
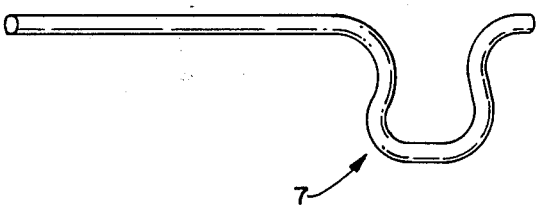
FIG. 4 is a schematic illustration of a portion of a device according to the present invention wherein the arcuate segments of each leg of the crank merge directly with each other.

The configuration of legs 9 and 10 of crank 7, described hereinabove, with straight intermediate sections 12, 13 provided between segments 9', 9'' and 10', 10'' is produced with a large distance between crank pin 11 and the axis of torsion bar 1. When long straight intermediate segments 12, 13 are used, crank 7 can approach a trapezoidal shape. It is also within the scope of the present invention, with a short distance of crank pin 11 from the axis of torsion rod 1 to make each leg 9, 10 so that its segments 9', 9'' and 10', 10'' merge directly into one another such as shown in FIG. 2.

While we have shown and described only two embodiments in accordance with the present invention, it is understood that the same is not limited thereto but is susceptible of numerous changes and modifications as known to those skilled in the art and we, therefore, do not wish to be limited to the details shown and described herein but intend to cover all such changes and modifications as are encompassed by the scope of the appended claims.

We claim:

1. A device for counterbalancing a swivelable body part on a motor vehicle, such as a trunk lid on an automobile, comprising hinge means for the swivelable body part and a torsion bar, said torsion bar being bent to form a crank in the vicinity of a movable hinge part of said hinge means, intermediate lever means articulated on the movable hinge part and engaging the crank, said crank including a crank pin between two legs, the legs comprising first arcuate segments connected with the torsion bar and second arcuate segments connected with the crank pin, and wherein said first and second arcuate segments each extend through an arc of more than 90 degrees.

2. A device according to claim 1, wherein the first and second arcuate segments of each leg merge directly with each other.

3. A device according to claim 1, wherein said legs are each provided between their first and second arcuate segments with a straight intermediate segment, the intermediate segments of the two legs converging in the direction toward said torsion bar.

4. A device according to claim 2, wherein said torsion bar is made of round stock and wherein the average bending radius of each first and second arcuate segment of the legs is equivalent a diameter at least twice the diameter of the torsion bar.

5. A device according to claim 1, 3 or 4 wherein the first arcuate segments connecting the legs with the torsion bar are disposed a short distance apart.

* * * * *